US009281602B2

(12) United States Patent
Ruffner

(10) Patent No.: US 9,281,602 B2
(45) Date of Patent: Mar. 8, 2016

(54) MULTIPLE SOCKET

(71) Applicant: Walter Ruffner, Maienfeld (CH)

(72) Inventor: Walter Ruffner, Maienfeld (CH)

( * ) Notice: Subject to any disclaimer, the term of this patent is extended or adjusted under 35 U.S.C. 154(b) by 0 days.

(21) Appl. No.: 14/328,126

(22) Filed: Jul. 10, 2014

(65) Prior Publication Data

US 2015/0099380 A1 Apr. 9, 2015

(30) Foreign Application Priority Data

Jul. 10, 2013 (CH) ..... 1235/13

(51) Int. Cl.

| | |
|---|---|
| ***H01R 13/453*** | (2006.01) |
| ***H01R 27/00*** | (2006.01) |
| *H01R 103/00* | (2006.01) |
| *H01R 24/76* | (2011.01) |

(52) U.S. Cl.

CPC ..... *H01R 13/453* (2013.01); *H01R 13/4534* (2013.01); *H01R 27/00* (2013.01); *H01R 24/76* (2013.01); *H01R 2103/00* (2013.01)

(58) Field of Classification Search

USPC ..... 439/137, 138, 145, 136

See application file for complete search history.

(56) References Cited

U.S. PATENT DOCUMENTS

| | | | | |
|---|---|---|---|---|
| 4,867,694 | A * | 9/1989 | Short | 439/137 |
| 5,919,060 | A * | 7/1999 | Lee | 439/518 |
| 6,932,631 | B2 * | 8/2005 | Huang | 439/145 |
| 7,445,472 | B1 * | 11/2008 | Huang et al. | 439/138 |
| 7,445,513 | B1 * | 11/2008 | Lee | 439/652 |
| 7,753,700 | B2 * | 7/2010 | Ma | 439/133 |
| 7,857,640 | B1 * | 12/2010 | Lee et al. | 439/137 |
| 7,914,307 | B1 * | 3/2011 | Yang | 439/137 |
| 8,382,493 | B2 * | 2/2013 | Ruffner | 439/105 |
| 8,702,436 | B2 * | 4/2014 | Lee | 439/222 |
| 8,753,149 | B2 * | 6/2014 | Lee | 439/653 |

FOREIGN PATENT DOCUMENTS

| | | | |
|---|---|---|---|
| CN | 201438555 | U | 4/2010 |
| CN | 201732959 | U | 2/2011 |
| EP | 1917701 | A2 | 5/2008 |
| EP | 2133961 | A1 | 12/2009 |
| GB | 719387 | A | 12/1954 |
| WO | 2009152629 | A1 | 12/2009 |

* cited by examiner

*Primary Examiner* — Alexander Gilman

(74) *Attorney, Agent, or Firm* — Morriss O'Bryant Compagni, PC

(57) ABSTRACT

A socket has a plug board with first plug-in openings for appropriate pins of a plug of a first standard and with second plug-in openings for appropriate pins of a plug of a second standard. Provided in a spacing to the plug board are a first type of contact mounts for receiving plug pins of the first standard, and a second type of contact mounts for receiving plug pins of the second standard. Provided between the contact mounts and the plug board are protection elements which are movable out of a closed position in which the first and second plug-in openings are blocked, into an open position in which the plug-in openings are open. The protection elements are pretensioned into their respective closed positions by spring elements. The first and second protection elements are pretensioned into their respective end positions in different directions of movement by the spring elements.

20 Claims, 6 Drawing Sheets

MULTIPLE SOCKET

CROSS-REFERENCE TO RELATED APPLICATIONS

This application claims priority to Swiss Patent Application No. 01235/13 filed Jul. 10, 2013, the entirety of which is incorporated by this reference.

BACKGROUND

The invention relates to a socket, in particular to a travel adapter.

EP-A-1 917 701 discloses a socket for a plug, which socket has a first socket region and a second socket region which are electrically interconnected for an alternative use. The first socket region and the second socket region each have a base pair of contact mounts and a third contact mount and are configured to receive a first type of plug and a second type of plug. A protective device is provided to prevent an electric plug of an incorrect standard being inserted into a socket region. The protective device consists of two separate closure elements which can be moved between a closed position and an open position and cover a single socket region. The two closure elements are pretensioned into the closed position in the same direction by helical springs. When a first type of plug is inserted into the first socket region, only the first closure element is moved into the open position against the spring force by the plug pins. However, when a second type of plug is inserted into the second socket region, then both the first and the second closure elements are moved into the open position, because the first closure element rests against the second closure element. In this case, all the plug-in openings are open, which poses a safety risk.

WO 2009/15229 discloses an adapter part which has on the front a Schuko plug housing with Schuko plug contacts and has on the back a plug board with plug-in openings for introducing pins of plugs of different national standards. Provided in the Schuko plug housing behind the plug board is a plurality of terminals for receiving the plug pins of the different national standards. Arranged between the terminals is a so-called holding down device which is supported on one side on the end face of the Schuko plug housing and is supported on the other side on the underside of the plug board. A child safety device is provided between the plug board and the plug board-side end of the holding down device. The child safety device is arranged on the holding down device such that it can be moved in a specific direction. A spring which is supported at one end on the housing wall and at the other on the child safety device pretensions the child safety device into an end position, in which some of the plug-in openings are blocked. If the pins of a plug are inserted into the plug-in holes, the child safety device is pushed back against the force of the spring. However, a disadvantage of the described child safety device is that all the plug-in openings are exposed when a plug is inserted into the adapter part. This can pose a safety problem, since in this state, electrical contact with a current-conducting terminal could be produced by means of a further plug or by a pointed metallic item inserted through one of the other plug-in openings. A further disadvantage of the known adapter part is that the plug-in openings of the US standard are not blocked by the child safety device.

Advantages

Therefore, it is an advantage of the present invention to overcome the disadvantages of the prior art and to develop a socket or an adapter plug of the type described at the outset such that even the strictest safety standards are met. In particular, it is an advantage to prevent the establishment of an electrical contact with a current-conducting terminal by means of a pointed item when a plug is inserted into the adapter part. A further advantage is to provide a child safety device which can withstand fiddling attempts.

SUMMARY OF THE INVENTION

This and further advantages are achieved by the subject-matter according to the claims. Advantageous configurations of the subject-matter according to the invention are also defined in the claims.

The invention relates to a socket, in particular to a travel adapter, comprising a plug board with a first socket arrangement having first plug-in openings for appropriate pins of a plug of a first standard. Furthermore, the plug board has a second socket arrangement with second plug-in openings for appropriate pins of a plug of a second standard. Provided in a spacing to the plug board are a first type of contact mounts for receiving plug pins of the first standard, and a second type of contact mounts for receiving plug pins of the second standard. A first protection element is movable out of a closed position in which at least the first plug-in openings are blocked, into an open position in which the first plug-in openings are open. Likewise, a second protection element is movable out of a closed position in which at least the second plug-in openings are blocked, into an open position in which the second plug-in openings are open. The protection elements are pretensioned into their respective closed positions by spring elements.

The invention is distinguished by the fact that the first and second protection elements are pretensioned into their respective end positions in different directions of movement by the spring elements. In this respect, the first and second directions of movement of the first and second protection elements can be different and in particular can be opposite or can be at an angle to one another. Furthermore, the second protection element is arranged on the first protection element and is movable at an angle to the direction of movement of the first protection element. This arrangement has a first great advantage that it is thereby possible to realise an extremely compact construction. A further advantage is that all the plug-in openings are secured by one protection element. This is very important for a socket or a travel adapter.

The protection elements are advantageously arranged relative to one another such that when a plug of the first or second standard is inserted into the first or second plug-in openings, the respective other protection element and/or the respective other plug-in openings is/are blocked. This is an important safety aspect, because it does not allow the insertion of a pointed item into the free socket arrangement.

According to one embodiment, the two protection elements are movable in different directions in each case for opening and closing. This has the advantage that consequently, a mutual influencing, in particular blocking is possible.

The two protection elements can be pretensioned in each case into their respective closed position by separate spring elements. The first and second protection elements are advantageously mechanically interconnected or coupled together by the at least one first spring element. Since the first and second protection elements are pretensioned in opposite directions, a spring element acting between the protection elements is sufficient to pretension the protection elements into their closed position.

A built-in part for receiving the contact mounts, for example in the form of contact terminals can be provided in a known manner in the socket housing or adapter housing. The built-in part projects above the contact mounts in the insertion direction of the plugs so that sliding or guide surfaces for the protection elements can be formed on the built-in part. The partly current-conducting contact mounts are thereby fully accommodated in the built-in part.

Preferably formed on the protection elements in the region of the plug-in openings are ramps which are sloping, viewed in the closed direction. The ramps produce a force component opposed to the closed direction, which moves the protection element into the open position upon insertion of a suitable plug.

Advantageously provided approximately in the centre of at least one of the protection elements is an elevation on which the protection element can seesaw. In this respect, the elevation can be provided on the protection element itself or on the built-in part or housing. The elevation has the advantage that when an attempt is made to insert a pointed item into an individual plug-in opening, the protection element is pressed with the other end into the other plug-in opening, where the ramp is jammed in the plug-in opening.

According to another embodiment, arranged on the first protection element is the second protection element in the form of a slider which is arranged such that it can move substantially at a right angle to the direction of movement of the first protection element. This embodiment is distinguished by its compactness, because the slider is arranged directly on the first protection element.

It is advantageous when the first and/or second protection element can only be moved into the open position by the simultaneous insertion of a conductor pin and neutral pin of a plug. This feature affords increased safety against an electric shock, since the insertion of a single elongate item into one of the plug-in openings cannot move any of the protection elements. The protection element operates with a hook-shaped elevation in the ramp region and with the rocker in the case of a unilateral load such that it locks with the plug-in board on one side and blocks both plug-in openings.

BRIEF DESCRIPTION OF THE DRAWINGS

Embodiments of the invention will now be described with reference to the drawings, in which.

DETAILED DESCRIPTION OF THE ILLUSTRATED EMBODIMENTS

Figure 1:
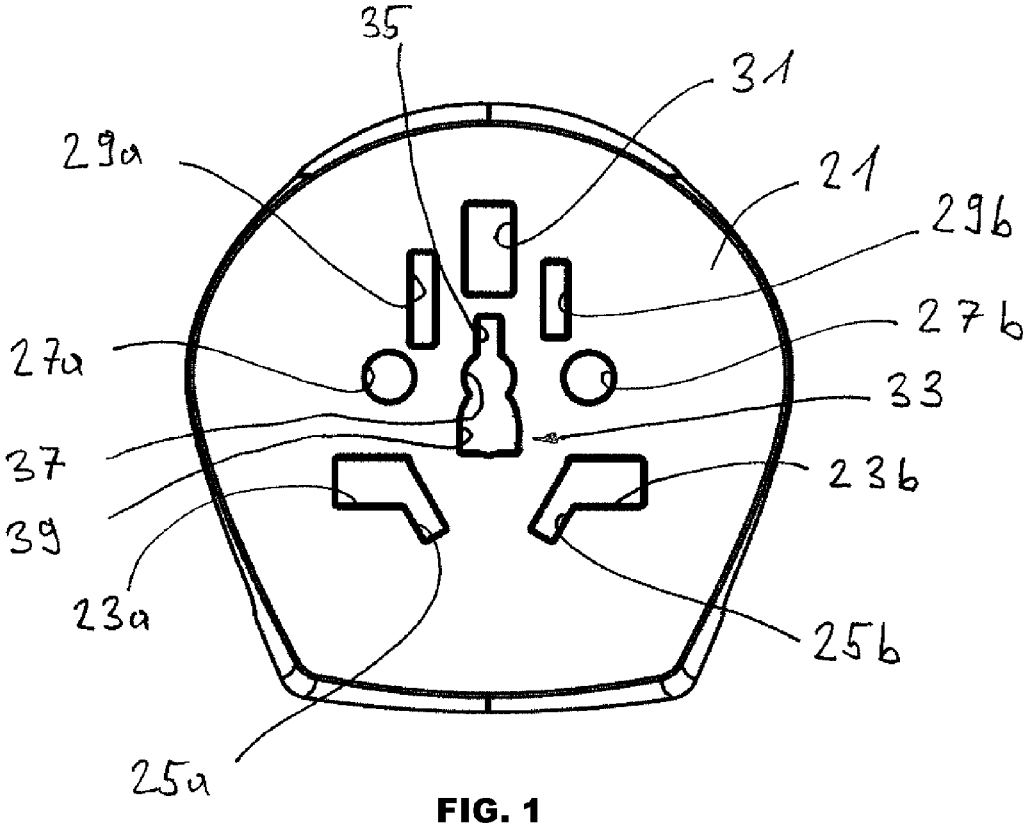
FIG. 1: is a plan view of the plug-in board of a first embodiment of a multiple socket which has plug-in openings to receive plugs of different national standards.

FIG. 1 shows a plug-in board 21 in which plug-in openings for receiving plugs of different national standards are provided. Specifically configured in said plug-in board 21 are the plug layouts of Great Britain, USA, Australia, Italy and Switzerland, the plugs being able to have a respective earth pin. In the plug layout according to FIG. 1, plug-in openings 23*a*, 23*b* are provided for receiving the conductor pins and neutral pins of plugs of the British standard (type G plug) and of the Australian standard. In this respect, the slots 25*a*, 25*b* of plug-in openings 23*a*, 23*b*, oriented at an angle to one another, are used to receive the flat conductor pins and neutral pins of the Australian plug.

The plug-in openings 27*a*, 27*b* are used to receive the conductor pins and neutral pins of plugs of the Swiss standard (type J plug) and of the Italian standard (type L plug).

The plug-in openings 29*a*, 29*b* are used to receive the conductor pins and neutral pins of plugs of the US standard (type B plug).

The plug-in openings for the earth pins of the respective national standard are provided in the centre plane between the plug-in openings of the conductor pins and neutral pins. Thus, plug-in opening 31 is used to receive the earth conductor pin of the Australian plug and the elongate plug-in opening 33 is used to receive the earth conductor pin of the Swiss, Italian and US plugs. In this respect, the slot-like extension 35 of plug-opening 33 is provided to receive the Australian earth pin. The circular widening 37 in the centre of the elongate plug-in opening 33 is used to receive the Italian earth pin and the sack-like widening 39 is used to receive the earth pins of the US and Swiss plugs.

Provided behind the plug-in openings in each case are female contacts, for example in the form of contact springs, for the respective plug pins. The configuration and arrangement of female contacts of this type is described in depth in WO 2009/15229, so that there is no need to describe them in more detail here.

For safety reasons, it is advisable to connect a respective protection element between the current-conducting female contacts and the plug-in openings. The protection element is to prevent incorrect types of plug being inserted into a specific plug-in opening and to prevent accidental contact with a current-conducting female contact. The protection element is also to prevent children from putting pointed items into the female contacts.

To make it impossible for access to be gained at any time to the current-conducting female contacts using pointed items or to prevent the insertion of incorrect plugs, the inventors propose the provision of a plurality of movable protection elements which, in the initial state, close at least all plug-in openings leading to the current-conducting female contacts.

Figure 2:
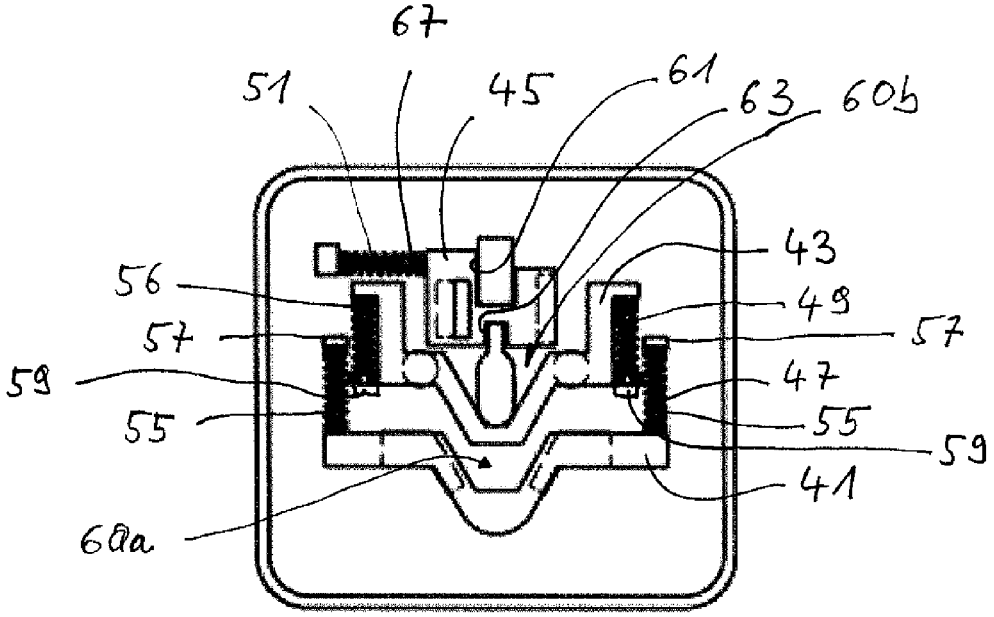
FIG. 2: schematically shows the protection elements which are arranged behind the plug-in openings and all of which are in the closed position.

Provided in the present case is a first protection element 41 for plug-in openings 23*a*, 23*b*, 25*a*, 25*b*, a second protection element 43 for plug-in openings 27*a*, 27*b* and a third protection element 45 for plug-in openings 29*a*, 29*b*. If a second protection element 45 is not provided, the third protection element 25 can be designated as the second protection element 43. Each protection element 41, 43, 45 is pretensioned into the closed position by an at least separate spring element 47, 49, 51 (FIG. 2). Projections of the socket housing, respectively of stationary built-in parts serve as counter-bearings for the spring elements 47, 49, 51. It is significant that the first and second protection elements 41, 43 are pretensioned into their end positions in opposite directions by the spring elements 47, 49. Consequently, during opening, the protection elements 41, 43 move towards one another and in the open position thereby block the respective other protection element in the closed position (see FIGS. 3 and 4).

In order that the protection elements 41, 43, 45 move into the open position upon insertion of a suitable plug, said protection elements 41, 43, 45 have under the plug-in openings sloping ramps 53, 54, the slope of which slants downwards in the closed direction. The insertion of a plug generates a force component, opposed to the closed direction, which presses the protection element into the open position. This is shown in FIGS. 8 to 12.

In the illustrated embodiment, the first and second protection elements 41, 43 consist of a bar-shaped plastics material part, on the ends of which are integrally formed pegs 55, 56. The spring elements 47, 49 which are configured as compression springs are positioned on the pegs 55. The spring elements 47, 49 are supported on counter-bearings 57, 59 which are part of the housing or of an installation in the housing. The protection elements 41, 43 have in the centre a V-shaped recess 60*a*, 60*b* which is necessary due to the compact arrangement of the different socket layouts. Otherwise it would be impossible to insert a 3-pin US plug into the plug-in board 21 in the closed position of the second protection element.

The third protection element 45 is in the form of a block with indents 61, 63 which, in the closed position, expose the plug-in openings 31, 33 for the British and Australian earth conductor pin. Integrally formed with the third protection element 45 is a peg 67, on which the spring element 51 is positioned. The spring element 51, a helical spring, is supported on the counter-bearing 65 and pretensions the protection element 45 into the closed position.

Figure 3:
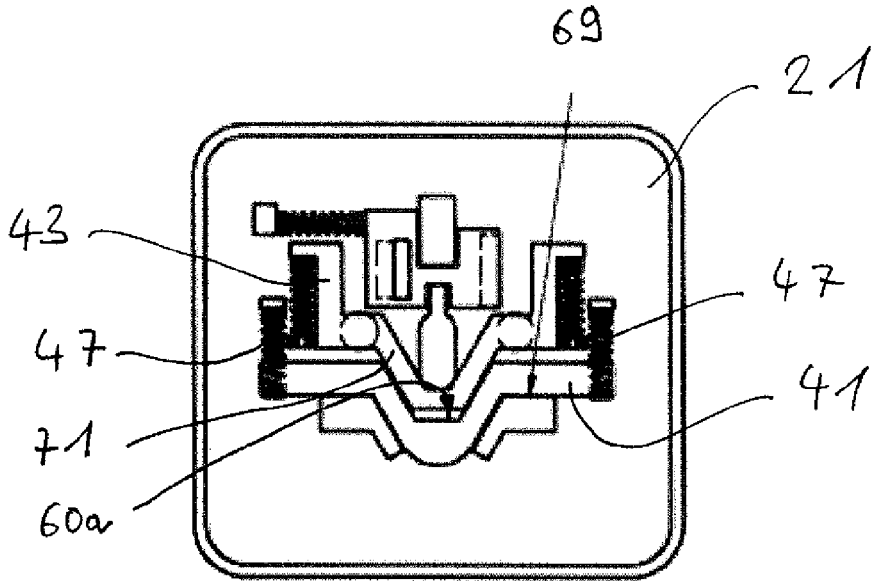
FIG. 3: shows the protection elements of FIG. 2 with a first protection element in the open position.

FIG. 3 shows the first protection element 41 in its open position 69; in this respect, it is pressed by the conductor pin and neutral pin of a UK or AU plug towards the second protection element 43 against the pressure of the first spring element 47. FIG. 3 shows that the first protection element 41 in the open position blocks the second protection element 43 in the closed position. During opening, the V-shaped recess 60*a* is pushed over the V-shaped extension 71 of the second protection element. This prevents the insertion of a plurality of plugs into the plug-in board 21.

Figure 4:
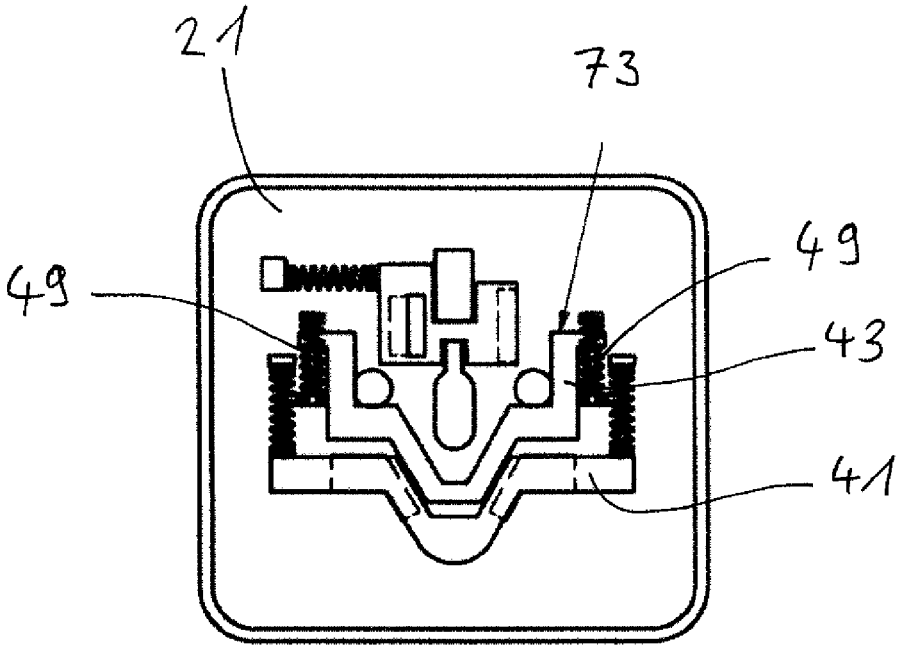
FIG. 4: shows the protection elements of FIG. 2 with a second protection element in the open position.

FIG. 4 shows the reverse case in which the second protection element 43 is pushed into the open position 73 by the conductor pin and neutral pin of a CH or IT plug. In this respect, the second spring elements 48 are compressed so that the second protection element 43 snaps back into the closed position after removing an IT or CH plug. In the open position 73, the first protection element 41 is blocked in its closed position.

Figure 5:
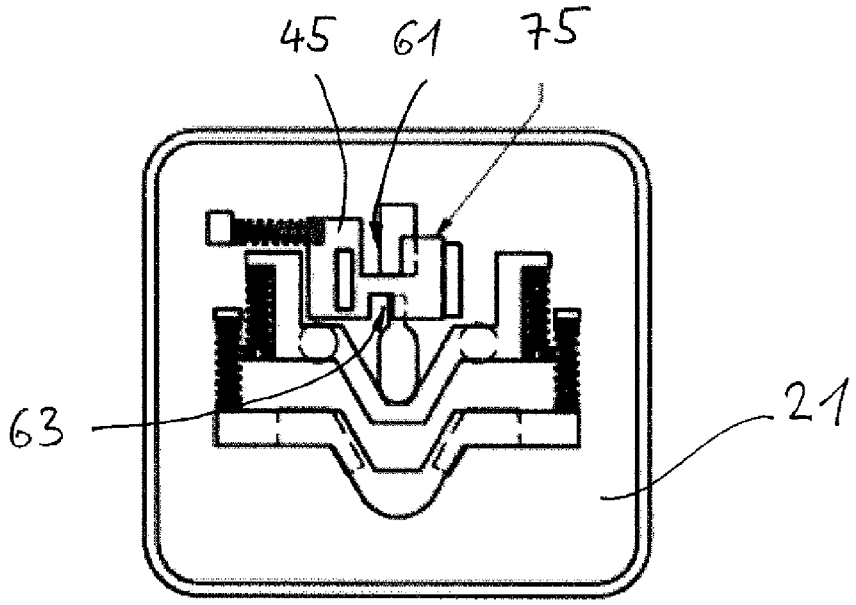
FIG. 5: shows the protection elements of FIG. 2 with a third protection element in the open position.

In the first embodiment of the multiple socket according to the invention, the third protection element 45 is configured independently of the other protection elements 41, 43. FIG. 5 shows the third protection element in its open position 75. The effect of the indents 61, 63 has already been described above. For reasons of space and so that the external dimensions of the plug-in board 21 do not become excessive, the third protection element 45 is arranged transversely to the first and second protection elements 41, 43.

Figure 6:
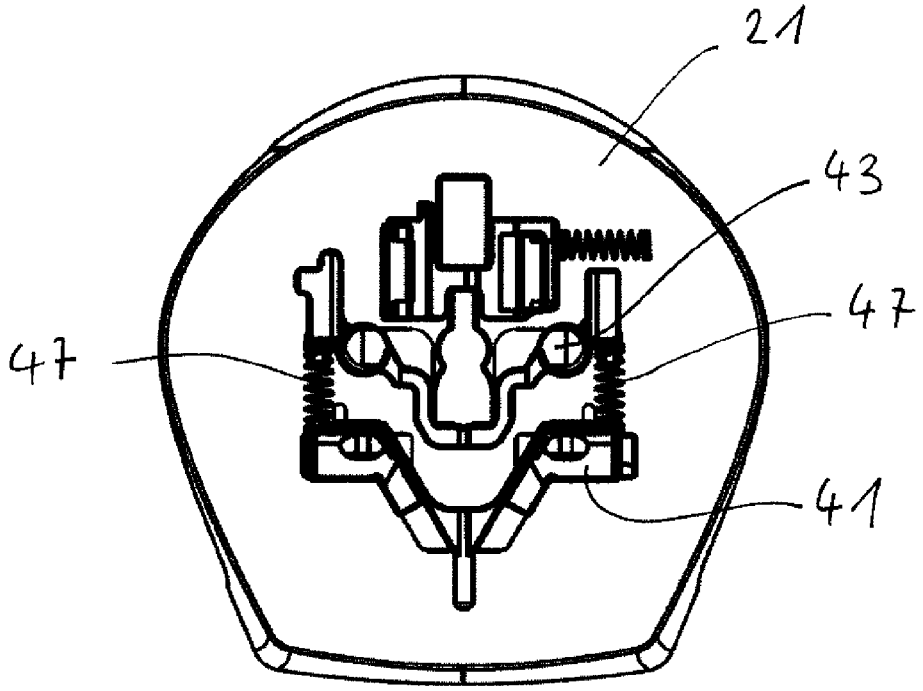
FIG. 6: is a plan view of a second embodiment, in which the first and second protection elements are pretensioned against one another by a single pair of springs.
Figure 7:
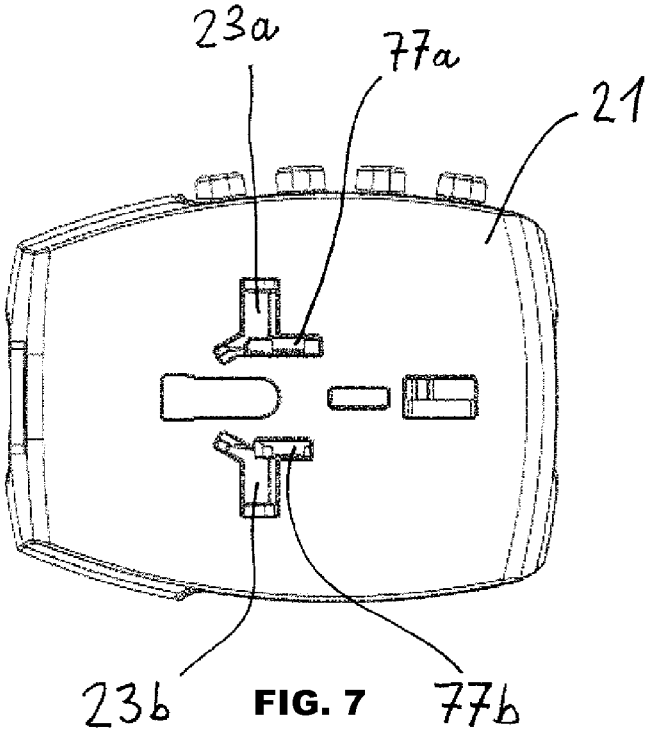
FIG. 7: is a plan view of the plug-in plate of a third embodiment of a multiple socket which is also configured plug-in openings to receive plugs of different national standards.

FIG. 6 shows a second embodiment of the invention in which the first and second protection elements 41, 43 are pretensioned against one another by a first pair of spring elements 47. This embodiment is of a particularly compact and simple construction, since it is possible to dispense with counter-bearings 57, 59. The first and second protection elements are supported against one another and cooperate with one another. If one protection element is in the open position, it presses the other protection element into the closed position by the different directions of movement of the protection elements 41, 43.

Figure 8:
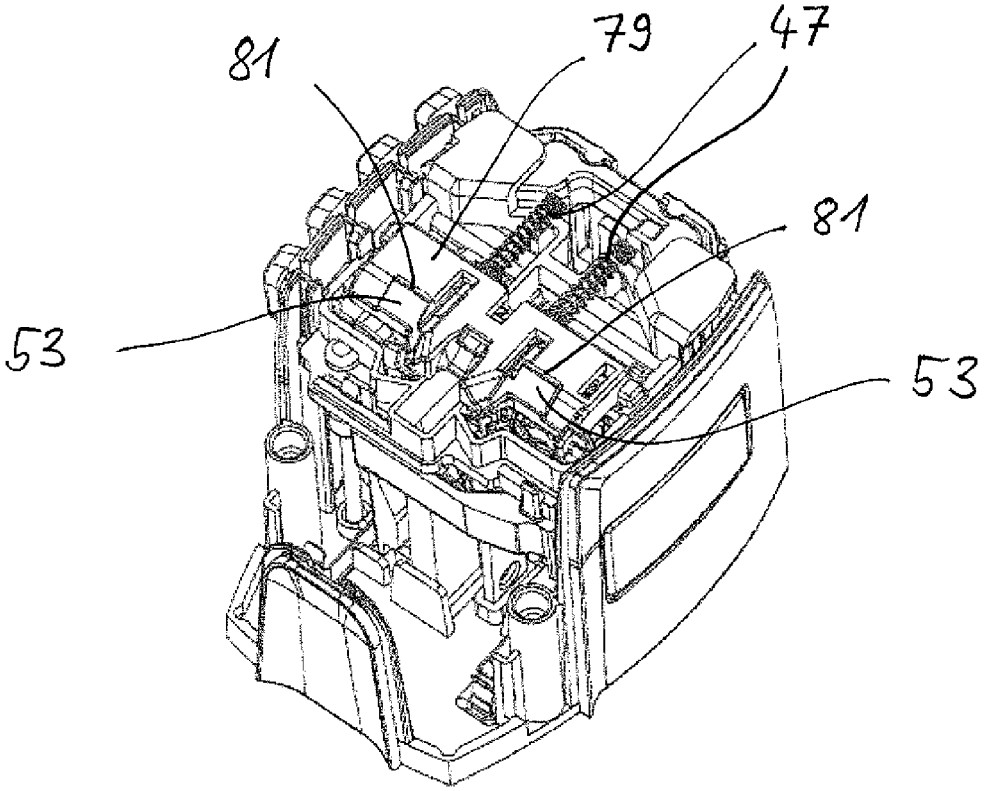
FIG. 8: is a perspective view of a first closed protection element into which a third protection element has been integrated.
Figure 9:
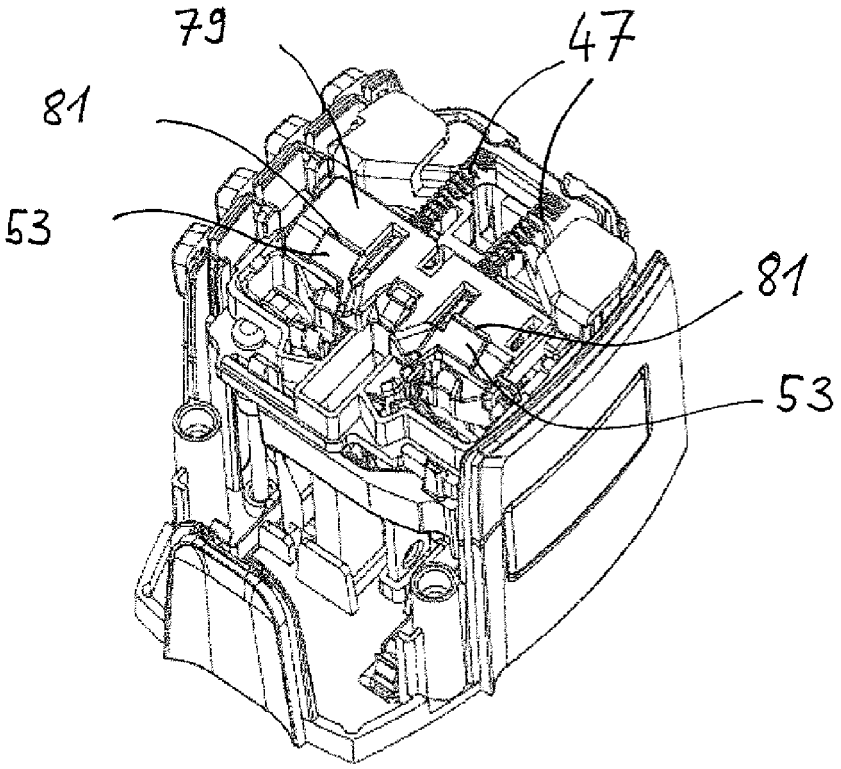
FIG. 9: shows the first protection element with integrated third protection element, the first protection element being in the open position.

FIGS. 7 to 12 show a third embodiment of the invention. The plug-in openings 23*a*, 23*b* are provided with upwards enlargements 77*a*, 77*b* such that a US plug can also be inserted into the plug-in openings 23*a*, 23*b*. In this example, the plug-in opening 33 is provided between the plug-in openings 23*a*, 23*b* so that Italian and Swiss plugs can also be accommodated. In this embodiment, the first, second and third protection elements 41, 43, 45 have been replaced by a single compact protection module 79, which acts as the first protection element 41. FIG. 8 shows the protection module 79 in the closed position and FIG. 9 shows it in the open position. Integrated together with the third spring element 51 into the protection module 79 is a slider 80 for closing the US plug openings. The slider 80 acts like the third protection element 45, but is arranged on the protection module 79. The slider 80 can only be brought into its open position when the protection module 79 is in the closed position. Otherwise, the US plug openings are at least partly covered by a UK, AU, IT or CH plug and the slider 80 is partly covered by the plug-in board 21. The protection module 79 is pretensioned into its closed position by a first spring element 47.

Figure 10:
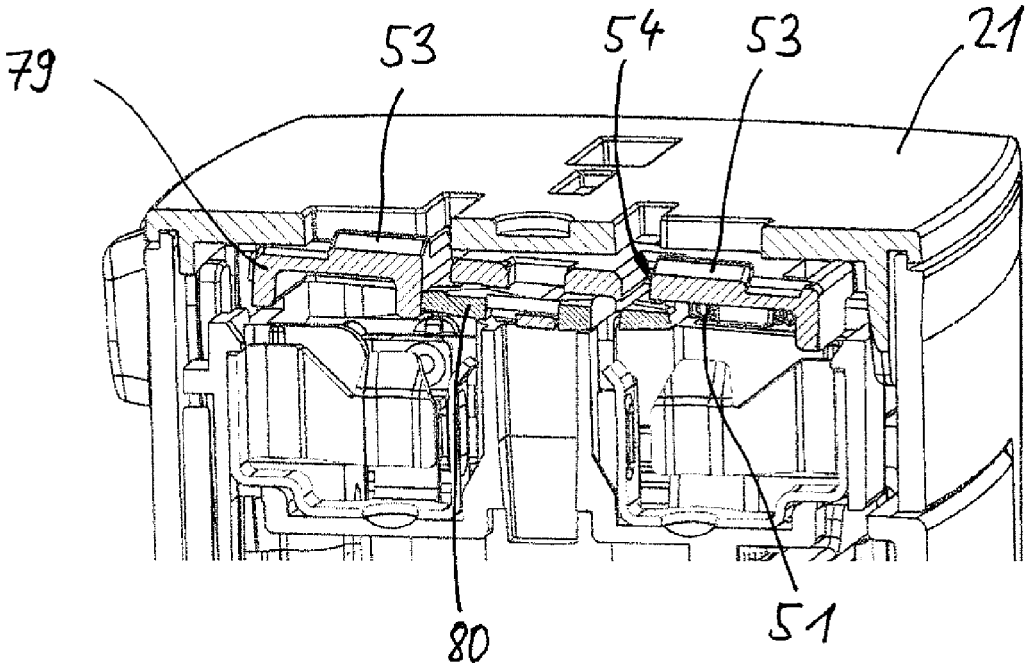
FIG. 10: shows the first protection element in a blocked sloping position.
Figure 11:
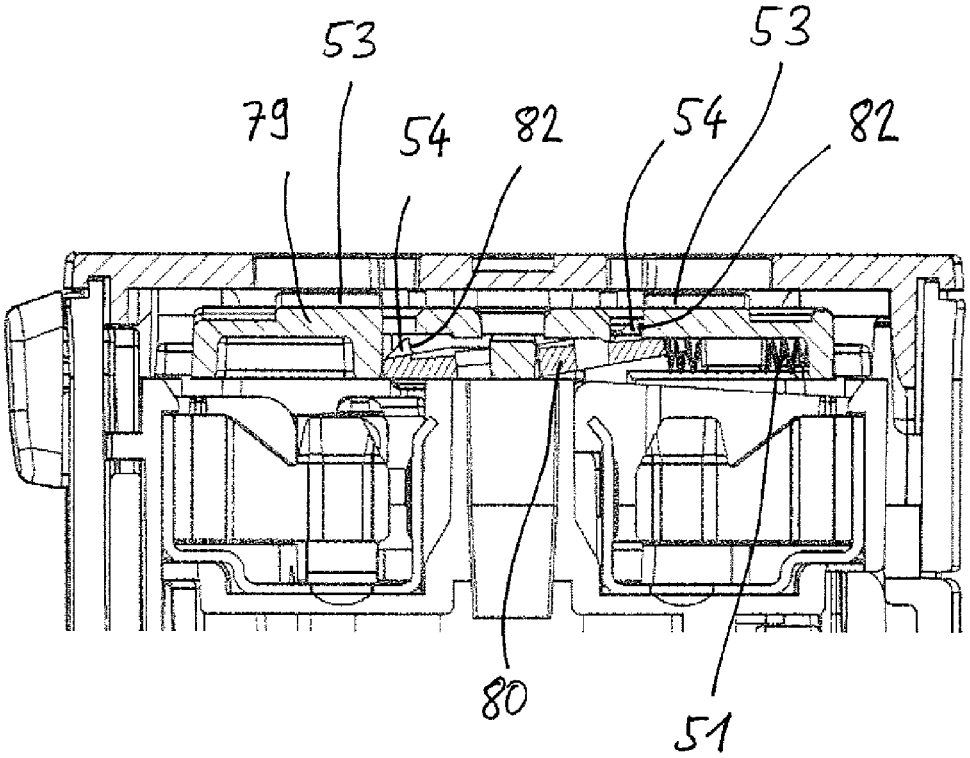
FIG. 11: is a sectional view through the first protection element with the third protection element in a blocked sloping position.
Figure 12:
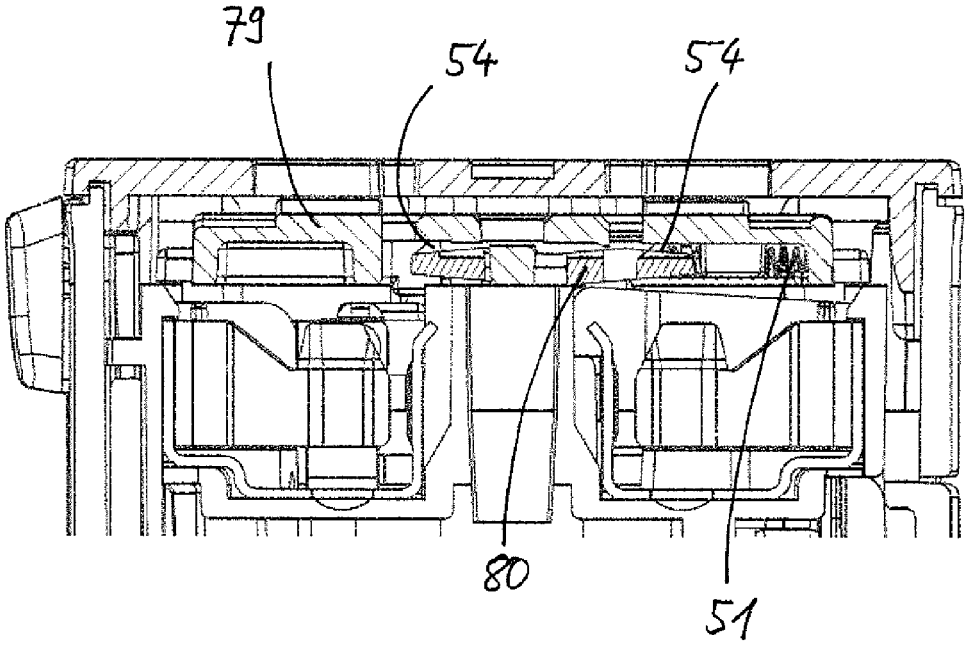
FIG. 12: is a sectional view through the first protection element with the third protection element in the open position.

The blocking function of the protection module 79, which basically also applies to the protection elements 41, 43, 45, is shown in FIGS. 10 to 12. The protection module 79 and the slider 80 are both provided with ramps 53, 54 which have already been described above. In the displacement direction of the open position, the ramps 53, 54 have a hook-shaped elevation 81, 82 which is shown in FIGS. 8, 9, 11 and 12. In the closed position, the protection module 79 and the slider 80 are locked on the plug-in board 21 or on the protection module by the elevation 81, 82. The protection module 79 and the slider 80 can only be moved when the ramps 53, 54 are simultaneously pressed downwards by the conductor pin and neutral pin. Otherwise, one of the elevations 81, 82 continues to block the movement (FIGS. 10 and 11).

The invention relates to a socket, in particular to a travel adapter, having a plug board with first plug-in openings for appropriate pins of a plug of a first standard and with second plug-in openings for appropriate pins of a plug of a second standard. Provided in a spacing to the plug board are a first type of contact mounts for receiving plug pins of the first standard, and a second type of contact mounts for receiving plug pins of the second standard. Provided between the contact mounts and the plug board are protection elements which are movable out of a closed position in which the first and second plug-in openings are blocked, into an open position in which the plug-in openings are open. The protection elements are pretensioned into their respective closed positions by spring elements. The invention is distinguished by the fact that the first and second protection elements are pretensioned into their respective end positions in different directions of movement by the spring elements. Furthermore, the second protection element is arranged against or on the first protection element and is movable at an angle to the direction of movement of the first protection element.

The invention claimed is:

1. An electrical socket, comprising:

a plug board defining:

a first set of plug-in openings configured for receiving a first set of pins of a first electrical plug of a first electrical plug standard configuration; and a second set of plug-in openings configured for receiving a second set of pins of a second electrical plug of a second electrical plug standard configuration;

a first set of contact mounts positioned behind the plug board configured for receiving the first set of pins;

a second set of contact mounts positioned behind the plug board configured for receiving the second set of pins;

a first protection element movable from a closed position, in which at least the first set of plug-in openings is blocked, to an open position, in which the first set of plug-in openings is open;

a second protection element comprising a slider integrated with the first protection element and movable from a closed position, in which at least the second set of plug-in openings is blocked, to an open position, in which the second set of plug-in openings is open; and at least one spring element biasing the first and second protection elements into their respective closed positions, the first and second protection elements being movable relative to one another by the at least one spring element, the second protection element movable at an angle to a direction of movement of the first protection element.

2. The socket according to claim 1, wherein the first and second protection elements are arranged relative to one another such that when the first electrical plug is inserted into the first set of plug-in openings, the second protection element is in a closed position to block the second set of plug-in openings.

3. The socket according to claim 2, wherein the first and second protection elements are arranged relative to one another such that when the second electrical plug is inserted into the second set of plug-in openings, the first protection element is in a closed position to block the first set of plug-in openings.

4. The socket according to claim 1, wherein the first protection element moves in an opposite direction to the second protection element when the first protection element moves from a closed position to an open position.

5. The socket of claim 4, wherein the second protection element moves in an opposite direction to the first protection element when the second protection element moves from a closed position to an open position.

6. The socket of claim 1, wherein the at least one spring element comprises a first spring coupled to the first protection element and a second spring coupled to the second protection element.

7. The socket of claim 1, wherein the at least one spring element comprises a common spring element.

8. The socket of claim 1, further comprising a built-in part for receiving the first and second set of contact mounts, the built-in part projecting above the first and second set of contact mounts in an insertion direction of the first and second set of pins into the plug board.

9. The socket of claim 8, wherein that the first and second set of contact mounts are arranged in the built-in part.

10. The socket of claim 8, wherein at least one of the built-in part and a housing define a plurality of guide surfaces, along which the first and second protection elements can slide.

11. The socket of claim 1, wherein the first and second protection elements proximate the plug-in openings include ramps for engaging pins of a respective first and second set of pins in which the engagement causes movement of the respective first and second protection elements.

12. The socket of claim 1, further comprising an elevation approximately at a center of at least one of the first and second protection elements includes an elevation upon which the at least one of the first and second protection element can see-saw.

13. The socket of claim 1, wherein the direction of movement of the first protection element is substantially at a right angle to the direction of movement of the second protection element.

14. The socket of claim 1, wherein at the first protection element can only be moved into the open position by the simultaneous insertion of both a conductor pin and neutral pin of the first plug into the first set of plug-in openings.

15. The socket of claim 14, wherein at the second protection element can only be moved into the open position by the simultaneous insertion of both a conductor pin and neutral pin of the second plug into the second set of plug-in openings.

16. An electrical socket, comprising:

a plug board defining:

a first set of plug-in openings configured for receiving a first set of pins of a first electrical plug of a first electrical plug standard configuration; and a second set of plug-in openings configured for receiving a second set of pins of a second electrical plug of a second electrical plug standard configuration;

a first set of contact mounts positioned behind the plug board configured for receiving the first set of pins;

a second set of contact mounts positioned behind the plug board configured for receiving the second set of pins;

a first protection element movable from a closed position, in which at least the first set of plug-in openings is blocked, to an open position, in which the first set of plug-in openings is open and wherein the first protection element can only be moved into the open position by the simultaneous insertion of both a conductor pin and neutral pin of the first plug into the first set of plug-in openings;

a second protection movable from a closed position, in which at least the second set of plug-in openings is blocked, to an open position, in which the second set of plug-in openings is open, wherein the second protection element can only be moved into the open position by the simultaneous insertion of both a conductor pin and neutral pin of the second plug into the second set of plug-in openings; and at least one spring element biasing the first and second protection elements into their respective closed positions, the first and second protection elements being movable relative to one another by the at least one spring element, the second protection element movable at an angle to a direction of movement of the first protection element.

17. The socket according to claim 16, wherein the first and second protection elements are arranged relative to one another such that when the first electrical plug is inserted into the first set of plug-in openings, the second protection element is in a closed position to block the second set of plug-in openings.

18. The socket according to claim 17, wherein the first and second protection elements are arranged relative to one another such that when the second electrical plug is inserted into the second set of plug-in openings, the first protection element is in a closed position to block the first set of plug-in openings.

19. The socket according to claim 16, wherein the first protection element moves in an opposite direction to the second protection element when the first protection element moves from a closed position to an open position.

20. The socket of claim 16, wherein the second protection element comprises a slider integrated with the first protection element.

* * * * *